US007832733B2

(12) United States Patent
Epstein et al.

(10) Patent No.: US 7,832,733 B2
(45) Date of Patent: Nov. 16, 2010

(54) SHOOTING SKILL AMUSEMENT DEVICE

(75) Inventors: Erica Epstein, 31549 S. Woodland Rd., Pepper Pike, OH (US) 44124; Rachel Leizman, Pepper Pike, OH (US); Katherine Smythe, Shaker Heights, OH (US); Lucy Taft, Pepper Pike, OH (US)

(73) Assignee: Erica Epstein, Pepper Pike, OH (US)

( * ) Notice: Subject to any disclaimer, the term of this patent is extended or adjusted under 35 U.S.C. 154(b) by 0 days.

(21) Appl. No.: 12/474,596

(22) Filed: May 29, 2009

(65) Prior Publication Data

US 2009/0298620 A1 Dec. 3, 2009

Related U.S. Application Data

(60) Provisional application No. 61/130,193, filed on May 29, 2008.

(51) Int. Cl.
*A63B 63/08* (2006.01)
*A63F 7/20* (2006.01)

(52) U.S. Cl. ..... 273/317.3; 273/348; 273/397; 273/398; 273/402; 473/481; 473/433

(58) Field of Classification Search ..... 273/317, 273/317.1, 317.3, 397–402, 407; 473/433, 473/479, 481–483; D21/701, 702, 704, 705, D21/305

See application file for complete search history.

(56) References Cited

U.S. PATENT DOCUMENTS

| | | | | |
|---|---|---|---|---|
| 2,306,898 | A | 1/1942 | Palmer | |
| 3,082,002 | A | 3/1963 | Goldfarb | |
| 3,132,864 | A | 5/1964 | Glass et al. | |
| 4,171,133 | A | 10/1979 | Morrison et al. | |
| 4,198,049 | A | 4/1980 | Kurita | |
| 4,266,763 | A | 5/1981 | Collins | |
| 5,035,423 | A | 7/1991 | Arciniega | |
| 5,074,552 | A | 12/1991 | Gomez et al. | |
| 5,330,175 | A | 7/1994 | Kim | |
| 5,358,237 | A | 10/1994 | Yu | |
| 5,842,699 | A * | 12/1998 | Mirando et al. | 273/317.3 |
| 6,536,770 | B1 | 3/2003 | Yang | |
| 6,772,745 | B2 | 8/2004 | McEachen et al. | |
| 6,918,591 | B2 | 7/2005 | D'Amico et al. | |
| 2003/0153413 | A1 | 8/2003 | Wood et al. | |
| 2009/0298620 | A1 * | 12/2009 | Epstein et al. | 473/433 |

* cited by examiner

*Primary Examiner*—Raleigh W. Chiu
(74) *Attorney, Agent, or Firm*—Fay Sharpe LLP

(57) ABSTRACT

A basketball amusement device comprises a backboard, a basket, and a self-propelled carriage. The backboard has a surface and the basket is attached to the surface of the backboard. The basket is adapted to receive a tossed ball. A support connects the backboard to the carriage. The self-propelled carriage includes a drive mechanism configured to move the carriage and backboard. The amusement device moves a predetermined distance across an associated support surface in response to the ball being received in the basket.

20 Claims, 5 Drawing Sheets

SHOOTING SKILL AMUSEMENT DEVICE

CROSS REFERENCE TO RELATED APPLICATIONS

This application claims priority from U.S. Provisional Patent Application Ser. No. 61/130,193 filed May 29, 2008 and is incorporated herein by reference.

BACKGROUND

Exemplary embodiments herein relate to a device for testing and enhancing one's skill at hitting a target with a game piece. In particular, the present disclosure herein is directed to a shooting-skill amusement device employing a basketball hoop and backboard mounted on a carriage that moves the hoop across a support surface in response to a successful shot.

A variety of basketball-type amusement games are known. Most of these games include stationary basketball hoops and backboards which are mounted within partially enclosed areas. Players are positioned at a set distance from and directly in front of the fixed hoops for shooting basketballs. The basketballs are returned to the players via an inclined surface beneath the basketball hoop. The basketballs usually remain, en masse, at the bottom of the inclined surface until shot at the basketball hoop by the player. Play continues until a timer-activated automatic mechanism intercepts the basketballs on an upper portion of the inclined surface and precludes them from returning to the player. A scoring device calculates the number of successfully shot basketballs and permits the player to compete with himself or herself or another.

Other known automated basketball-type amusement games include basketball hoops and backboards which are rotatable or movable towards or away from players. The basketball hoops and backboards are generally enclosed within a box-shaped frame or housing. These games were developed for presenting players with a variety of different angled shots and distances from the players to the basketball hoops and backboards. While the known movable basketball games present players with a variety of shots and are an improvement over the games having stationary hoops and backboards, they are generally less than satisfactory for numerous reasons. The known movable basketball games require and occupy considerable space for their assembly and operation, which is particularly problematic when those games are intended for use in areas of limited space. With the known movable basketball games, it is difficult to control the delivery and return of basketballs one at a time to players. Instead, basketballs are usually returned to players en masse. Further, the mechanisms which move the known movable basketball hoops and backboards generally are complicated and expensive.

BRIEF DESCRIPTION

According to one aspect, a basketball amusement device comprises a basket and a self-propelled carriage. The basket is adapted to receive a tossed ball. A support connects the basket to the carriage. The carriage includes a drive mechanism configured to move the carriage and basket. The amusement device moves a predetermined distance across an associated support surface in response to the ball being received in the basket.

According to another aspect, a basketball amusement device comprises a backboard, a basket and a free-standing carriage. The backboard has a surface, and the basket is attached to the surface of the backboard. The basket is adapted to receive a tossed ball. A support connects the backboard to the carriage. The carriage includes a drive mechanism configured to move the amusement device across an associated support surface in response to the ball being received in the basket. A ball return chute is connected to one of the backboard and the support, and the chute slopes downwardly away from the basket. The ball return chute is disposed generally beneath the basket for receiving the tossed ball from the basket. A switching assembly is operatively connected to the drive mechanism for activating the drive mechanism. The switching assembly is selectively actuated by movement of the ball down the ball return unit away from the basket.

According to yet another aspect, a basketball amusement device comprises a backboard, a basket, and a free-standing, self-propelled carriage. The backboard has a surface, and the basket is attached to the surface of the backboard. The basket is adapted to receive a tossed ball. A support connects the backboard to the carriage. The carriage includes a drive mechanism configured to move the amusement device across an associated support surface in response to the ball being received in the basket. A ball return chute is connected to one of the backboard and the support, and the chute slopes downwardly away from the basket. The ball return chute is disposed generally beneath the basket for receiving the tossed ball from the basket. A switching assembly is operatively connected to the drive mechanism for activating the drive mechanism. The switching assembly is selectively actuated by movement of the ball down the ball return chute away from the basket. The switching assembly is configured to remain in its actuated condition for a predetermined amount of movement of the ball down the ball return chute.

DETAILED DESCRIPTION

Figure 1:
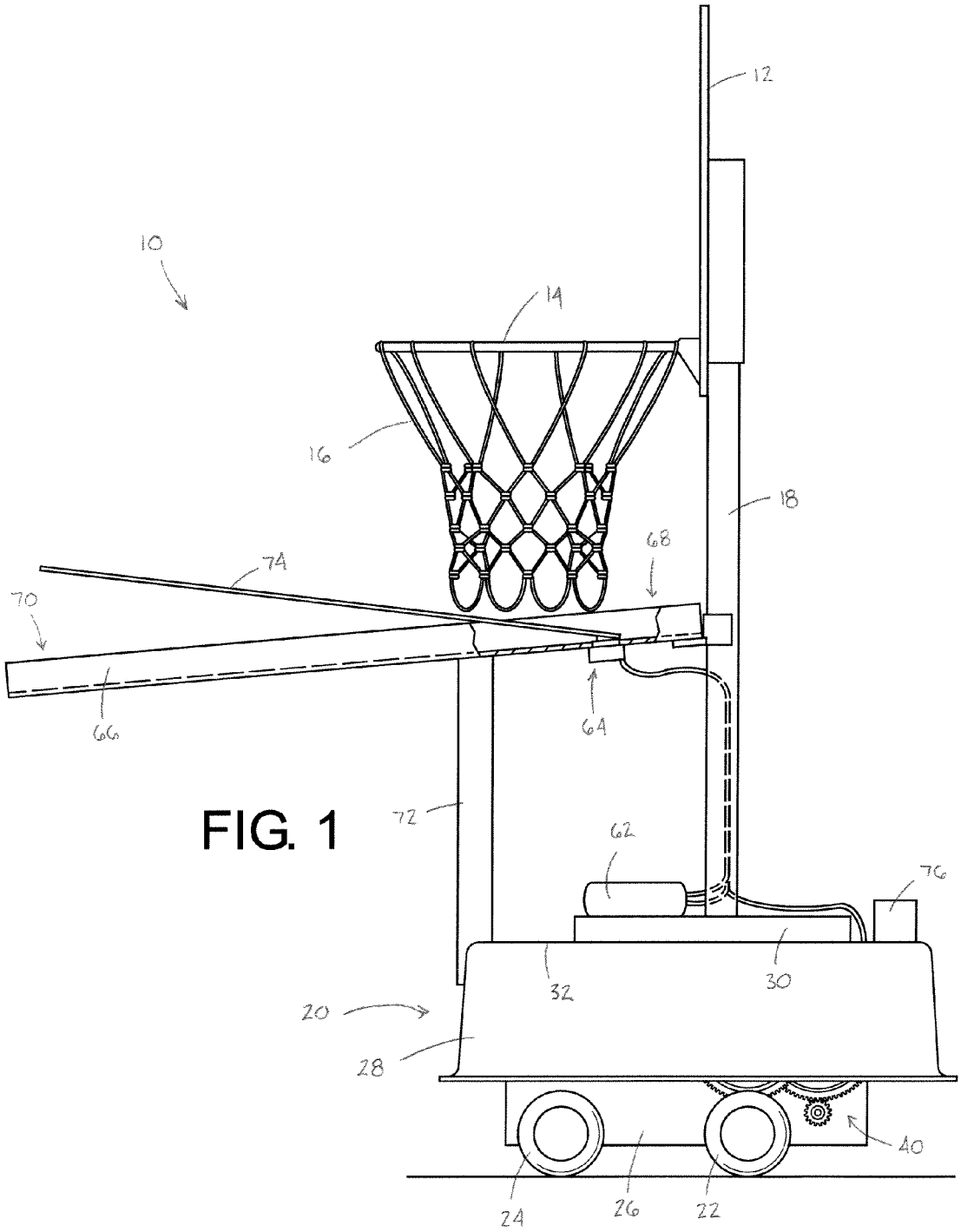
FIG. 1 is a side view of an exemplary shooting-skill amusement device according to the present disclosure.

It should, of course, be understood that the description and drawings herein are merely illustrative and that various modifications and changes can be made in the structures disclosed without departing from the present disclosure. All references to direction and position, unless otherwise indicated, refer to the orientation of the amusement device illustrated in the drawings and should not be construed as limiting the claims appended hereto.

Figure 2:
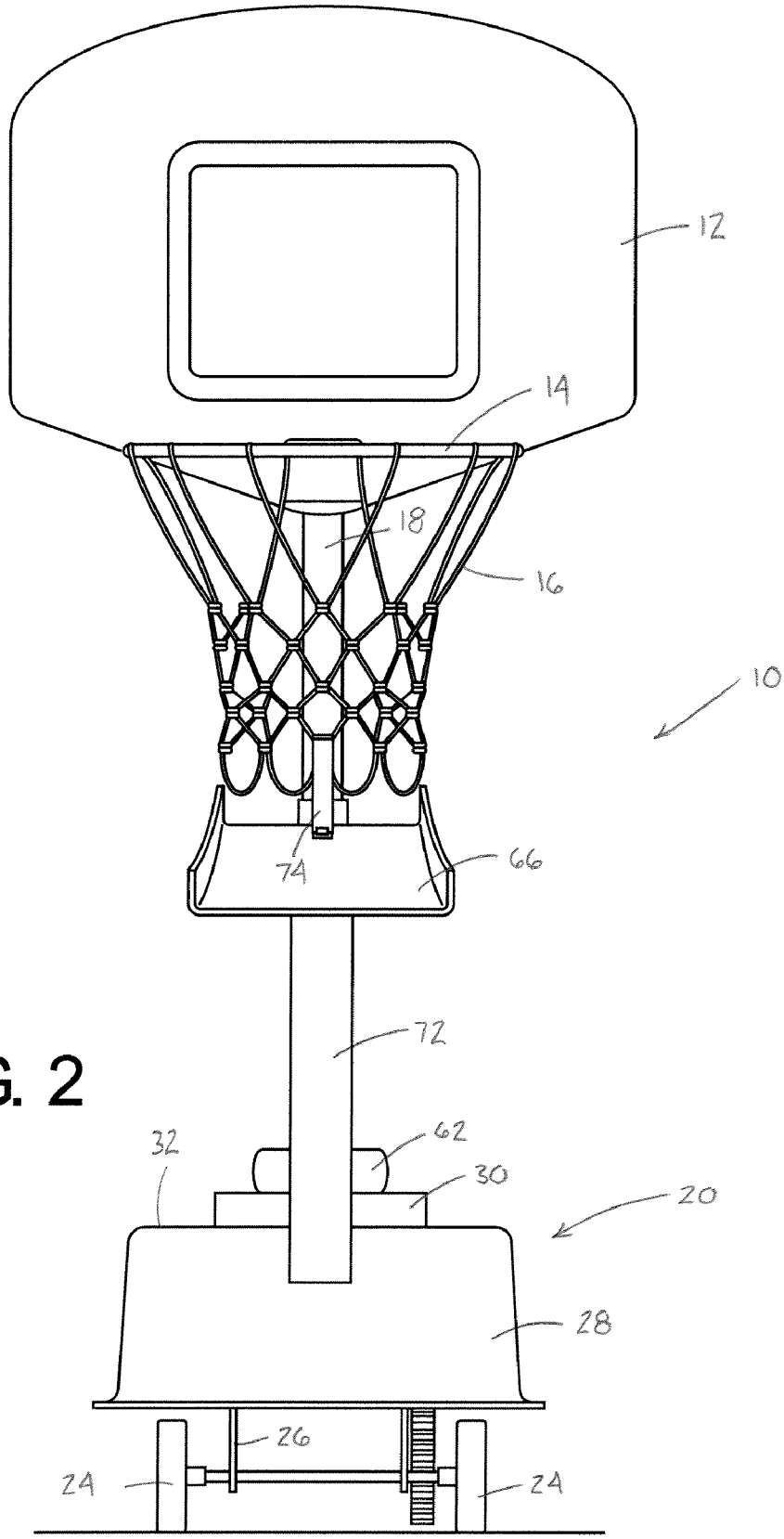
FIG. 2 is a front view of the shooting-skill amusement device of FIG. 1.

Referring now to the drawings, wherein like numerals refer to like parts throughout the several views, FIGS. 1 and 2 illustrate an exemplary embodiment of an amusement device according to the present disclosure. The amusement device, designated generally by reference numeral 10, includes a backboard 12 and a basketball hoop or basket 14 attached to a surface of the backboard. A net 16 can depend from the hoop; although, this is not required. The amusement device 10 further includes a support, such as a vertical post 18, to which the backboard-and-hoop assembly is mounted. In the depicted embodiment of the present disclosure, the inside diameter of the hoop is approximately 6 inches, which is suitable for use with a ball having a diameter of approximately 4 inches. It should be appreciated that alternative dimensions for the inside diameter of the hoop and the diameter of the ball are contemplated, including a regulation-sized hoop for use with a regulation-sized basketball.

With continued reference to FIG. 1, the post 18 extends upwardly from a powered, free-standing carriage 20. In the depicted embodiment, the self-propelled carriage 20 includes a drive mechanism (see FIGS. 3 and 4) configured to move the amusement device 10 across an associated support surface, such as a bedroom floor, in response to the ball being received in the hoop 14. The carriage includes at least one drive wheel. As shown, the carriage 20 includes two drive wheels 22 and two non-driven wheels 24 (only one of each is shown in FIG. 1) mounted on a chassis 26. The chassis 26 is covered by an exterior shell 28. A base member 30 is mounted on a top surface 32 of shell 28. The lower end of the post 18 is secured to base member 30 via known manners to provide the connection between the backboard 12 and hoop 14 on one hand and the carriage 20 on the other hand. It should be appreciated that the lower end of the post can be connected directly to the carriage.

Figure 3:
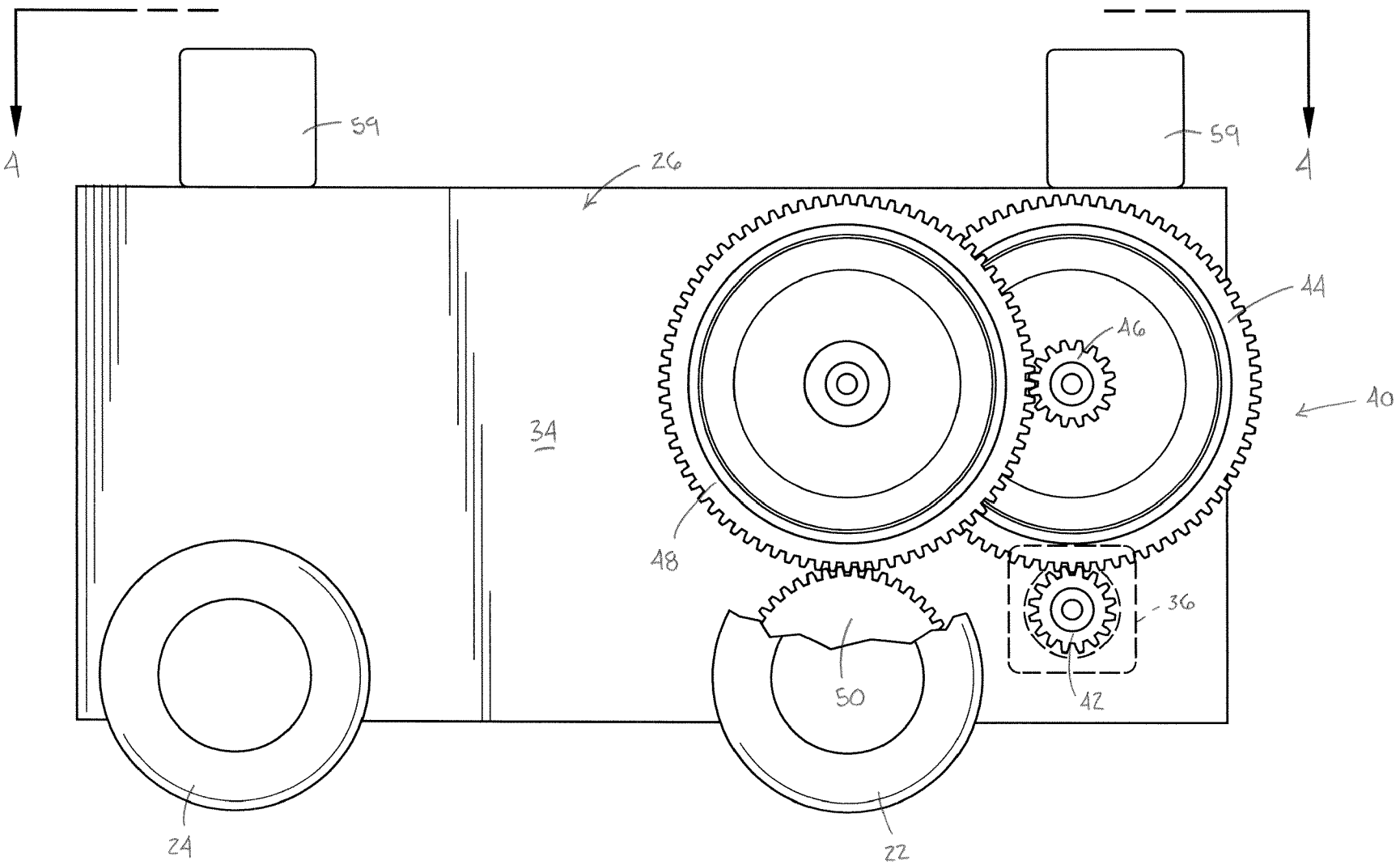
FIG. 3 is a partial side view of a carriage including a drive mechanism of the shooting-skill amusement device of FIG. 1.
Figure 4:
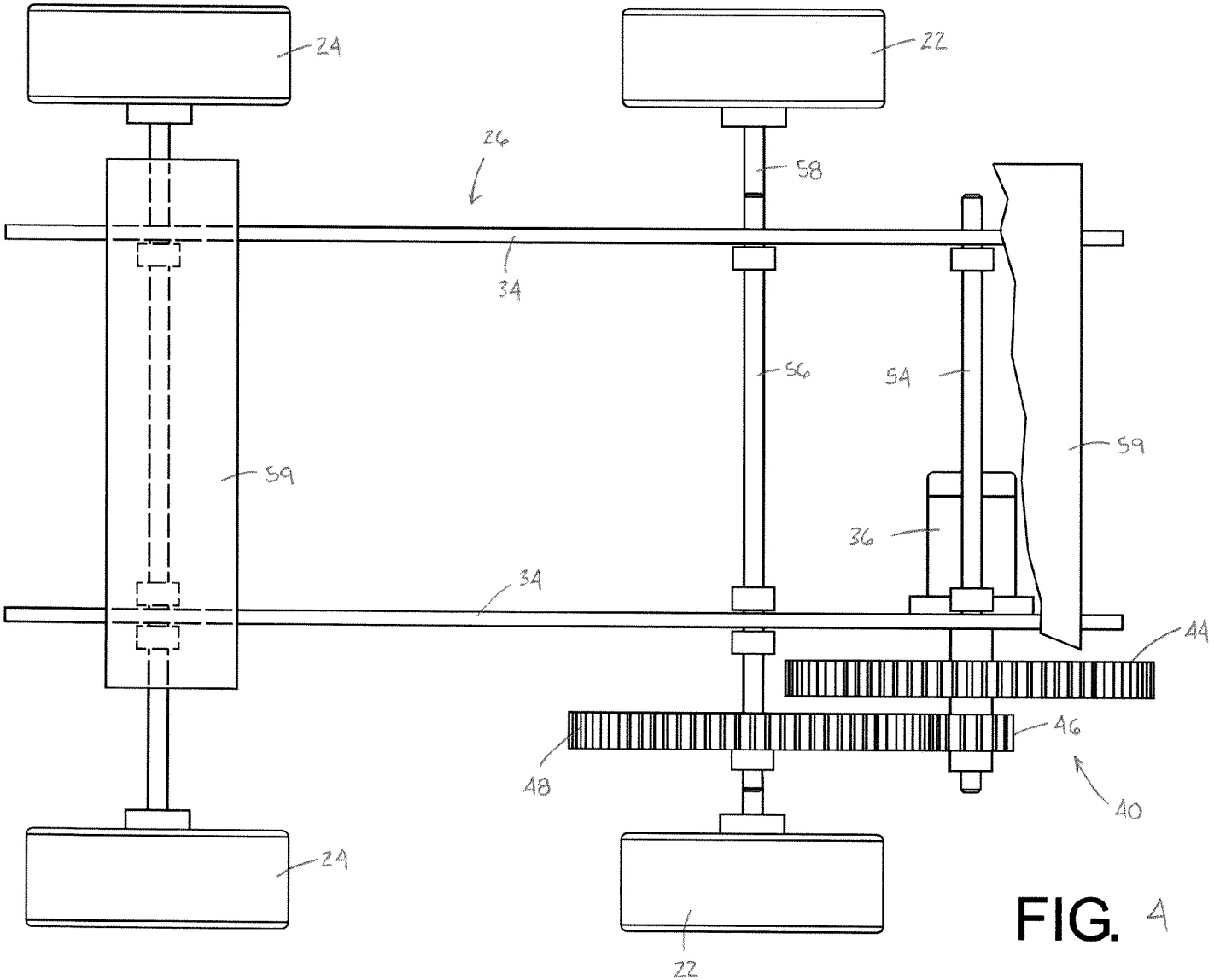
FIG. 4 is a top view, partially broken away, of the carriage of FIG. 3.

FIGS. 3 and 4 show the carriage 20 with the shell 28 removed to expose the chassis 26. The chassis 26 includes two side plates 34 rigidly connected to each other by cross members (not shown). The drive mechanism is provided for applying torque to rotate the drive wheels 22 and linearly moving the chassis 26 across an associated support surface. The drive mechanism generally includes an electric motor 36 mounted inside the chassis 26 and connected by a driveshaft (not shown) to a gear train 40. The gear train 40 transfers the rotation and torque of the motor 36 to at least one of drive wheels 22.

With reference to FIGS. 3 and 4, the gear train 40 includes a first pinion 42 driven directly by the motor 36 via the motor's driveshaft and a first large gear 44, which meshes with the first pinion 42. The gear train 40 also includes a second pinion 46, which is fixed to, coaxial with, and rotates with the first large gear 44; and a second large gear 48, which meshes with the second pinion 46. The second large gear 48 in turn meshes with a wheel gear 50, which is fixed to, coaxial with, and rotates with one of the drive wheels 22 (on the right-hand side of FIG. 4). In the specific embodiment shown in FIGS. 3 and 4, the pinions 42 and 46 have fifteen teeth, the large gears 44 and 48 have seventy-five teeth, and the wheel gear 50 has forty-five teeth. This combination results in an overall gear ratio of 15:1, meaning that the rotational speed (in RPM) of the drive wheels 22 is 1/15 that of the motor 36. It should be appreciated that alternative gear ratios are contemplated.

With reference to FIG. 4, the large gears 44 and 48 are mounted respectively on idler shafts 54 and 56, which span the width of the chassis 26 and are rotatably supported by the opposed side plates 34. In addition, the two drive wheels 22 are connected by a shaft 58 that transfers the torque imparted by right-side drive wheel 22 to left-side drive wheel 22. Also shown in FIGS. 3 and 4 are mounting blocks 59, which provide spacing between the chassis 26 and the shell 28.

Figure 6:
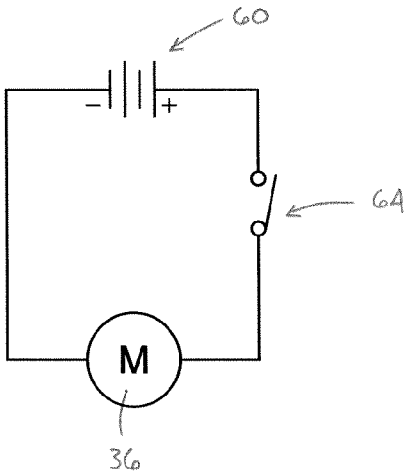
FIG. 6 is a schematic drawing of an electrical circuit that moves the shooting-skill amusement device of FIG. 1.
Figure 5:
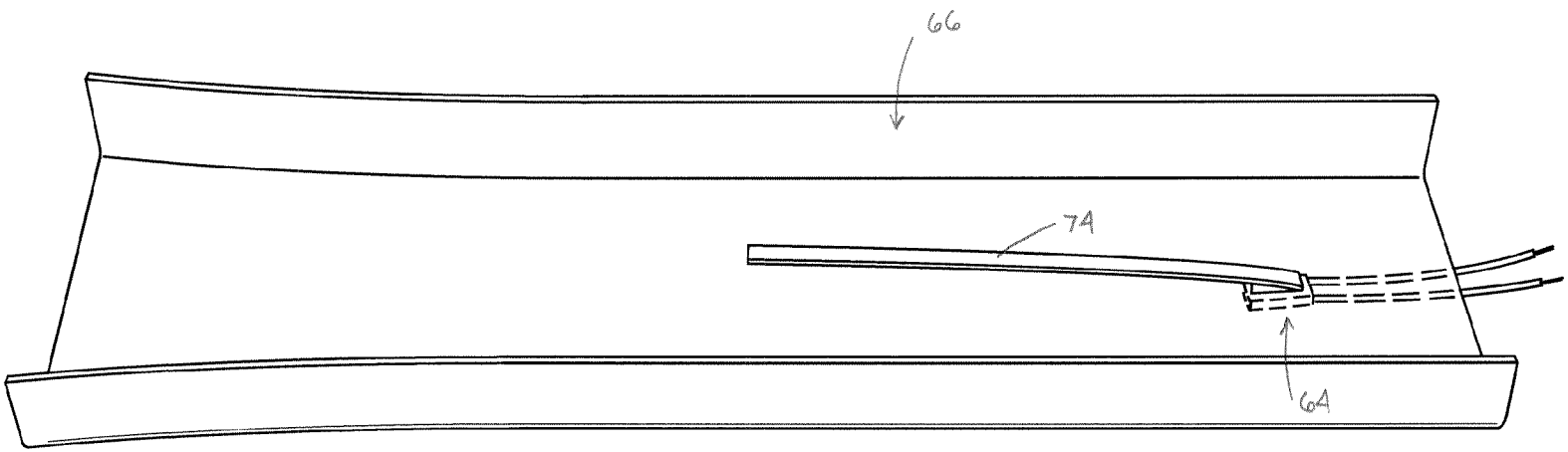
FIG. 5 is a side view of an exemplary ball return unit and a switching assembly of the shooting-skill amusement device of FIG. 1.

With reference to FIGS. 1 and 5, and additional reference to the circuit shown in FIG. 6, power to the motor 36 is provided by a battery 60, such as two AA batteries, held in a battery receptacle 62. The receptacle is connected to one of the carriage 20 and the base 30. Wires connect the battery 60 and the motor 36, and the circuit is controlled by an exemplary switching assembly. The switching assembly is operatively connected to the drive mechanism of the carriage 20 for activating the drive mechanism. The switching assembly is selectively actuated by movement of a ball down a ball return unit, such as discharge chute 66, away from the hoop 14. The switching assembly is configured to remain in its actuated condition for a predetermined amount of movement of the ball down the ball return unit. As shown, the exemplary switching assembly includes a switch 64 mounted to the ball return unit 66 and an elongated actuating member 74 operatively connected to the switch for actuating the switch. As will be discussed in greater detail below, the elongated actuating 74 member has a length, movement of the amusement device across the associated support surface being at least partially dependent on the length of the elongated actuating member.

In the exemplary embodiment, the switch 64 is a normally open, spring-biased, two-position leaf switch, although this is not required. The switch 64 is operatively associated with the ball return unit 66 and is actuated as the ball rolls down the ball return unit away from the basket 14. As will be discussed in greater detail below, actuation of the switch 64 activates the drive mechanism, which in turn, applies torque to rotate the drive wheels 22 to move the device 10.

As shown, the ball return unit 66 is a generally trough-shaped structure having a first end 68 disposed beneath the basket 14 and a second, distal end 70 extending away from the post 18. In the example shown in the drawings, particularly in FIG.1, the ball return unit 66 is connected at its first end 68 to one of the backboard 12 and the post 18, and it slopes downwardly from first end 68 toward second end 70. The ball return unit 66 can also be secured to the shell 26 of carriage 20, such as by a vertical strut 72. The downward slope of the ball return unit should be such that the ball is returned to the player regardless of the distance between the player and the amusement device 10. In the device shown in FIG. 1, the angle between the surface of the ball return unit 66 and the vertical post 18 is approximately 85 degrees, although this is not required.

In the depicted embodiment, the switch 64 is mounted in an opening formed in the ball return unit 66. Attached to the actuating leaf of the switch 64 is the elongated actuating member or leaf extension 74, which is positioned in the ball return unit 66 and extends above the surface of the discharge chute 66 while the switch is in its spring-biased open position. Fabricating the leaf extension 74 from a rigid, lightweight material such as balsa wood minimizes the chance that the weight of the leaf extension itself will overcome the spring bias of the switch 64 and close the circuit prematurely.

The purpose of the shooting skill device is to develop the skill of shooting a basketball (sized appropriately for the diameter of hoop 14) through the hoop. The method employed develops shooting skill by moving the hoop when a basket is made by the player, so that the player's next shot is attempted at a basket in a different position (e.g., a position of greater distance from the player). The manner in which the shooting skill device 10 is used will now be described, with reference to the drawings.

When the player makes a basket by shooting the ball through the hoop 14, the ball exits the bottom of the net 16 and lands on a portion of leaf extension 74 adjacent switch 64. The weight of the ball causes leaf extension 74 to pivot downwardly toward the surface of ball return unit 66 and to remain in that position as the ball rolls down the ball return unit away from the basket. The downward pivoting of leaf extension 74 closes switch 64 and completes the circuit shown in FIG. 7, thus applying the voltage of the battery 60 across the motor 36. Closing the circuit causes the motor 36 to rotate and apply torque to the drive wheels 22 through the gear train 40, with the result that the drive wheels 22 rotate and the amusement device 10 with its hoop 14 moves away from the player. To facilitate the exit of the ball from the net 16 and its travel down the discharge chute 66, the opening in the bottom of the net facing away from post 18 can be enlarged. Counterweight 76, mounted on the surface 32 of the shell 28 at the rear end of the shell as shown in FIG. 1, assists in preventing the device 10 from tipping forward during use.

As long as the leaf extension 74 is held in its downward-pivoted position by the ball, the switch 64 remains in its closed actuated condition, the motor 36 continues to deliver torque rotating the drive wheels 22 of the carriage 20, and the device 10 continues to move. The amount of carriage movement resulting from a made shot depends on the length of the leaf extension 74 and the downward pitch of the ball return unit 66; the ball exiting the bottom of the net 16 will roll down the ball return unit and hold the switch 64 in its closed condition until the ball reaches the end of leaf extension 74. Once the ball reaches the end of leaf extension 74 and no longer is holding it in its downward-pivoted position, the spring bias of switch 64 will open the circuit, and the motor will stop delivering torque to the drive wheels 22, causing movement of the carriage to stop.

In the embodiment shown in FIGS. 1 and 2, the leaf extension is about 14 inches long, and the device 10 moves about 7 inches after each successful shot. As shown in FIG. 5, the leaf extension 74 is about 8 inches long, and the device 10 moves about 4 inches after each successful shot. Lengthening or shortening the leaf extension will respectively increase or decrease the distance the device moves after each successful shot. Although the leaf extension shown in the drawings is of a fixed length, it should be appreciated that an adjustable-length leaf extension would facilitate changing the distance the device 10 moves after a successful shot.

In accordance with the above description, the amusement device 10 will move away from the player for a prescribed distance each time a shot is made, with the next attempt requiring a longer shot. Conversely, when the player misses the shot, the amusement device 10 does not move, and the player can continue his or her attempts at the same distance until a shot is made. Although the method as described moves the carriage 20 and basketball hoop 14 away from the player as a result of a successful shot, movement in other directions can be accomplished by changing the angular orientation of the backboard and hoop relative to the direction of movement of the carriage and/or by reversing the wiring connecting the batteries to the motor to cause movement in the reverse direction. As is evident from the foregoing, the amusement device 10 is a free-standing and freely movable basketball game which occupies minimal space for operation.

In the device shown in the drawings, it is possible for an errantly shot ball to miss the hoop and still cause the amusement device 10 to move. This can result when the ball does not reach the hoop 14 but lands directly in the discharge chute 66 in front of the basket and actuates the leaf extension and switch. To prevent this situation from occurring, the amusement device 10 can be provided with a cover over the discharge chute in the form, for example, of an elongated U-shaped structure that would create a tunnel for the ball exiting the net 14 and rolling down the chute.

In the particular device disclosed herein, the carriage, motor, and gear train were obtained from a kit provided as part of SAE International's A World in Motion® program, specifically, Kit No. AWIMCH2KIT. The side plates 34, the gears 42, 44, 46, 48, 50, and the wheels 22, 24 of the depicted embodiment are formed of light-weight plastic materials, as are the discharge chute 66 and shell 28. The present disclosure, however, is not limited to any particular set of hardware or materials. Many other configurations and materials can be employed, with the understanding that the size and capacity of the motor and/or battery pack might need to be increased if higher-weight materials are used or if a larger device with a bigger hoop and ball is to be constructed.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A basketball amusement device comprising:

a basket adapted to receive a tossed ball;

a self-propelled carriage including a drive mechanism configured to move the carriage and basket; and a support for connecting the basket to the carriage, wherein the amusement device moves a predetermined distance across an associated support surface in response to the ball being received in the basket.

2. The amusement device of claim 1, wherein the support includes a backboard having a surface, the basket being attached to the surface of the backboard.

3. The amusement device of claim 1, wherein the carriage includes at least one drive wheel mounted on a chassis, and the drive mechanism includes an electric motor operatively connected to a gear train, the gear train transferring rotation and torque of the motor to the at least one drive wheels.

4. The amusement device of claim 1, further including a ball return unit having a first end disposed generally beneath the basket for receiving the tossed ball from the basket and a second end, the first end being connected to the support, the ball return unit sloping downwardly from the first end toward the second end.

5. The amusement device of claim 4, wherein the ball return unit is trough-shaped.

6. The amusement device of claim 4, further including a switching assembly operatively connected to the drive mechanism for activating the drive mechanism, the switching assembly being selectively actuated by movement of the ball down the ball return unit away from the basket.

7. The amusement device of claim 6, wherein the switching assembly is configured to remain in its actuated condition for a predetermined amount of movement of the ball down the ball return unit.

8. The amusement device of claim 6, wherein the switching assembly includes a switch mounted to the ball return unit and an elongated actuating member operatively connected to the switch for actuating the switch.

9. The amusement device of claim 8, wherein the elongated actuating member has a length, movement of the amusement device across the associated support surface being at least partially dependent on the length of the elongated actuating member.

10. The amusement device of claim 8, wherein the elongated actuating member is at least partially positioned in the ball return unit, wherein as the ball moves down the ball return unit away from the basket, the ball engages the elongated actuating member displacing the elongated actuating member downwardly, wherein downward movement of the elongated actuating member actuates the switch which, in turn, activates the drive mechanism, the switch remaining in its actuated condition until the ball disengages the elongated actuating member.

11. The amusement device of claim 8, wherein the elongated actuating member includes a first end coupled to the switch and a second end extending generally above the ball return unit.

12. The amusement device of claim 8, wherein the switch is a normally open, spring-biased, two-position leaf switch, the elongated actuating member being connected to an actuating leaf of the switch.

13. A basketball amusement device comprising:

a backboard having a surface;

a basket attached to the surface of the backboard and adapted to receive a tossed ball; and a free-standing carriage including a drive mechanism configured to move the amusement device across an associated support surface in response to the ball being received in the basket;

a support for connecting the backboard to the carriage;

a ball return chute connected to one of the backboard and the support, the ball return chute being disposed generally beneath the basket for receiving the tossed ball from the basket, the ball return chute sloping downwardly away from the basket; and a switching assembly operatively connected to the drive mechanism for activating the drive mechanism, the switching assembly being selectively actuated by movement of the ball down the ball return unit away from the basket.

14. The amusement device of claim 13, wherein the carriage includes a pair of drive wheels and a pair of non-driven wheels mounted on a chassis, and the drive mechanism includes an electric motor operatively connected to a gear train, the gear train transferring rotation and torque of the motor to at least one of drive wheels.

15. The amusement device of claim 13, wherein the switching assembly includes a switch mounted to the ball return chute and an elongated actuating member operatively connected to the switch for actuating the switch.

16. The amusement device of claim 15, wherein movement of the amusement device across the associated support surface is dependent on a length of the elongated actuating member and a downward pitch of ball return chute.

17. The amusement device of claim 16, wherein the elongated actuating member is at least partially positioned within the ball return chute, the weight of the ball displacing the elongated actuating member downwardly, wherein downward movement of the elongated actuating member actuates the switch, the ball holding the switch in its actuated condition until the ball reaches an end of the elongated actuating member.

18. The amusement device of claim 15, wherein the switch is mounted in an opening formed in the ball return chute.

19. A basketball amusement device comprising:

a backboard having a surface;

a basket attached to the surface of the backboard and adapted to receive a tossed ball; and a free-standing, self-propelled carriage including a drive mechanism configured to move the amusement device across an associated support surface in response to the ball being received in the basket;

a support for connecting the backboard to the carriage;

a ball return chute connected to one of the backboard and the support, the ball return chute being disposed generally beneath the basket for receiving the tossed ball from the basket, the ball return chute sloping downwardly away from the basket; and a switching assembly operatively connected to the drive mechanism for activating the drive mechanism, the switching assembly being selectively actuated by movement of the ball down the ball return chute away from the basket, wherein the switching assembly is configured to remain in its actuated condition for a predetermined amount of movement of the ball down the ball return chute.

20. The amusement device of claim 19, wherein the switching assembly includes a switch mounted to the ball return chute and an elongated actuating member operatively connected to the switch for actuating the switch, wherein movement of the amusement device across the associated support surface is dependent on a length of the elongated actuating member and a downward pitch of ball return chute.

* * * * *